US010393136B2

(12) United States Patent
Aschermann

(10) Patent No.: US 10,393,136 B2
(45) Date of Patent: Aug. 27, 2019

(54) FAN WHEEL HAVING A RIB STRUCTURE PROVIDED ON A HUB

(71) Applicant: MAHLE International GmbH, Stuttgart (DE)

(72) Inventor: Uwe Aschermann, Karlsruhe (DE)

(73) Assignee: MAHLE International GmbH, Stuttgart (DE)

( * ) Notice: Subject to any disclaimer, the term of this patent is extended or adjusted under 35 U.S.C. 154(b) by 219 days.

(21) Appl. No.: 15/451,815

(22) Filed: Mar. 7, 2017

(65) Prior Publication Data

US 2017/0175762 A1 Jun. 22, 2017

Related U.S. Application Data

(63) Continuation of application No. PCT/EP2015/070629, filed on Sep. 9, 2015.

(30) Foreign Application Priority Data

Sep. 22, 2014 (DE) ..... 10 2014 219 046

(51) Int. Cl.

| | |
|---|---|
| ***F04D 29/32*** | (2006.01) |
| ***F04D 19/00*** | (2006.01) |
| ***F04D 29/66*** | (2006.01) |
| ***F01P 5/02*** | (2006.01) |

(52) U.S. Cl.

CPC ..... *F04D 29/329* (2013.01); *F01P 5/02* (2013.01); *F04D 19/002* (2013.01); *F04D 29/666* (2013.01); *F04D 29/668* (2013.01)

(58) Field of Classification Search

CPC ..... F04D 29/32; F04D 29/329; F04D 29/668; F04D 19/002; F04D 29/666; F01P 5/02

See application file for complete search history.

(56) References Cited

U.S. PATENT DOCUMENTS

| | | | | | |
|---|---|---|---|---|---|
| 2,857,094 | A | * | 10/1958 | Erwin | F01D 5/282 156/221 |
| 3,403,844 | A | * | 10/1968 | Stoffer | F01D 5/282 156/173 |
| 3,572,969 | A | * | 3/1971 | McLimore | F01D 5/028 416/193 R |
| 4,187,055 | A | * | 2/1980 | Barnstead | F04D 29/382 416/132 A |
| 4,629,644 | A | * | 12/1986 | Matuska | B29C 53/564 416/134 A |

(Continued)

FOREIGN PATENT DOCUMENTS

| | | |
|---|---|---|
| CN | 201794829 U | 4/2011 |
| CN | 202789721 U | 3/2012 |

(Continued)

*Primary Examiner* — David Hamaoui

(74) *Attorney, Agent, or Firm* — Muncy, Geissler, Olds & Lowe, P.C.

(57) ABSTRACT

A fan wheel for propelling cooling air for an internal combustion engine, including a hub on which a plurality of fan blades is arranged and which includes a rib structure that extends peripherally and has substantially rectangular and flat ribs having an edge region. The ribs sit on the hub by the edge regions thereof and have a longitudinal direction that extends substantially tangentially to the circumferential direction of the hub, the ribs being in contact with one another.

12 Claims, 3 Drawing Sheets

(56) References Cited

U.S. PATENT DOCUMENTS

| | | | | | |
|---|---|---|---|---|---|
| 4,762,466 | A * | 8/1988 | Bouiller | B64C 11/06 | 416/205 |
| 4,863,352 | A * | 9/1989 | Hauser | B64C 11/06 | 416/204 R |
| 5,331,811 | A * | 7/1994 | Giberson | F16D 33/20 | 29/889.5 |
| 6,375,427 | B1 * | 4/2002 | Williams | F04D 29/326 | 416/169 A |
| 8,596,984 | B2 | 12/2013 | Bessho et al. | | |
| 9,273,696 | B2 * | 3/2016 | Kampf | F04D 29/023 | |
| 9,447,791 | B2 | 9/2016 | Aschermann et al. | | |
| 2012/0201705 | A1 | 8/2012 | Spaggiari et al. | | |
| 2014/0044575 | A1 * | 2/2014 | Naffziger | F04D 29/188 | 417/423.1 |

FOREIGN PATENT DOCUMENTS

| | | | |
|---|---|---|---|
| CN | 202326418 | U | 7/2012 |
| CN | 202833302 | U | 3/2013 |
| CN | 203476797 | U | 3/2014 |
| DE | 41 17 342 | C1 | 9/1992 |
| DE | 299 03 619 | U1 | 7/1999 |
| DE | 100 05 857 | A1 | 8/2000 |
| DE | 10 2010 042 325 | A1 | 4/2012 |
| GB | 2 348 251 | A | 9/2000 |
| JP | 2009202481 | A | 9/2009 |
| WO | WO 01/79704 | A2 | 10/2001 |

* cited by examiner

FAN WHEEL HAVING A RIB STRUCTURE PROVIDED ON A HUB

This nonprovisional application is a continuation of International Application No. PCT/EP2015/070629, which was filed on Sep. 9, 2015, and which claims priority to German Patent Application No. 10 2014 219 046.0, which was filed in Germany on Sep. 22, 2014, and which are both herein incorporated by reference.

BACKGROUND OF THE INVENTION

Field of the Invention

The invention relates to a fan wheel, in particular for propelling cooling air, in particular for an internal combustion engine, comprising a hub on which a plurality of fan blades is arranged and whereby the hub has a rib structure.

Description of the Background Art

So-called visco fans for engine cooling are fastened by means of a fluid friction coupling, a so-called visco coupling, to the crankshaft of the internal combustion engine and supply the internal combustion engine with air for cooling. Vibrations of the internal combustion engine are therefore transmitted via the coupling to the fan. The fan therefore experiences strong vibration excitations in all directions, both as axial displacements but also in the form of tilting.

A rotor for a semi-axially operating fan, which has a hub on which a plurality of fan blades is arranged, is known from DE 41 17 342 C1. The hub of the fan is provided with a hub ramp, which is arranged upwardly inclined on the outer side of the hub. The hub itself is provided with hollow spaces, which are separated from one another by radially extending webs. In this open hub structure, the fan blades merge directly into the flat hub.

DE 100 05 857 A1 discloses a blade wheel, in particular for a blower unit, in which the hub comprises a substantially ring-shaped wall, which is centered on the axis of rotation of the blade wheel. The blades are connected to a circumferential outer surface, which delimits the ring-shaped wall of the hub. The peripheral surface in this case comprises two zones, separated axially by the blades.

U.S. Pat. No. 6,375,427 B1 discloses a fan for cooling an internal combustion engine, which has a hub structure formed as an auxiliary structure. This hub structure has both radially extending and also diagonally and crosswise extending webs to increase the fan stability.

A hub structure of this kind is very expensive in terms of production and is not always sufficient to cancel out the vibrations of the internal combustion engine, which cause a strong excitation in the tilting and bending direction of the fan.

SUMMARY OF THE INVENTION

It is therefore an object of the invention to provide a fan wheel for propelling cooling air, in particular for an internal combustion engine, which despite the structurally simple design offers a rather high resistance to deflection of the fan wheel.

In an exemplary embodiment of the invention, the fan wheel for propelling cooling air, in particular for an internal combustion engine, has a hub on which a plurality of fan blades is arranged, whereby the hub has a circumferential rib structure. In a fan wheel, which is designed with a simple structure and nonetheless has a high resistance to tilting and bending of the fan wheel, the rib structure includes substantially rectangular and flat ribs having an edge region and sitting with the edge region thereof sit on the hub and oriented substantially tangentially to the circumferential direction of the hub in their longitudinal extent, the ribs being in contact with one another. As a result, the ribs achieve a predetermined length, so that they run sufficiently close to a center of the fan wheel. This has the advantage that a high resistance, in particular by the long ribs, to deflection of the fan wheel is produced and as a result the dynamic strength of the fan is increased. Because the flat ribs are attached to the flat hub, there is no costly hub structure.

The circumferential rib can be designed as polygonal or angular, whereby in the case of intersecting ribs this means in particular the radially outward outer contour of the rib structure.

Each flat rib can extend from one fan blade to another fan blade. Due to this design, the ribs obtain a predetermined length by means of which they can be made to pass close to the center of the fan wheel.

In an embodiment, the flat rib extends from the first fan blade to the directly adjacent fan blade. To increase further the stiffness and strength of the fan, in an alternative the straight rib can extend from the first fan blade to the next but one fan blade. It is also conceivable, however, that the flat rib extends from one fan blade to the third next fan blade. The dynamic strength of the fan is increased by the crossing of the flat ribs, which start from the different fan blades and lead to the corresponding first, second, or third next fan blade.

To increase the stiffness of the fan in the area of the attachment points of a coupling, the ribs formed flat or straight in this way run close to the screw points of the coupling, without crossing one another.

In an embodiment, a visco fan is provided, in particular for propelling cooling air for an internal combustion engine, comprising a fan wheel, which is connected to a shaft of the internal combustion engine via a visco coupling. The fan wheel of this visco coupling in this case has at least one of the features of the invention.

The invention will be described hereinbelow in greater detail based on at least one exemplary embodiment with reference to the figures in the drawing. In the drawing:

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
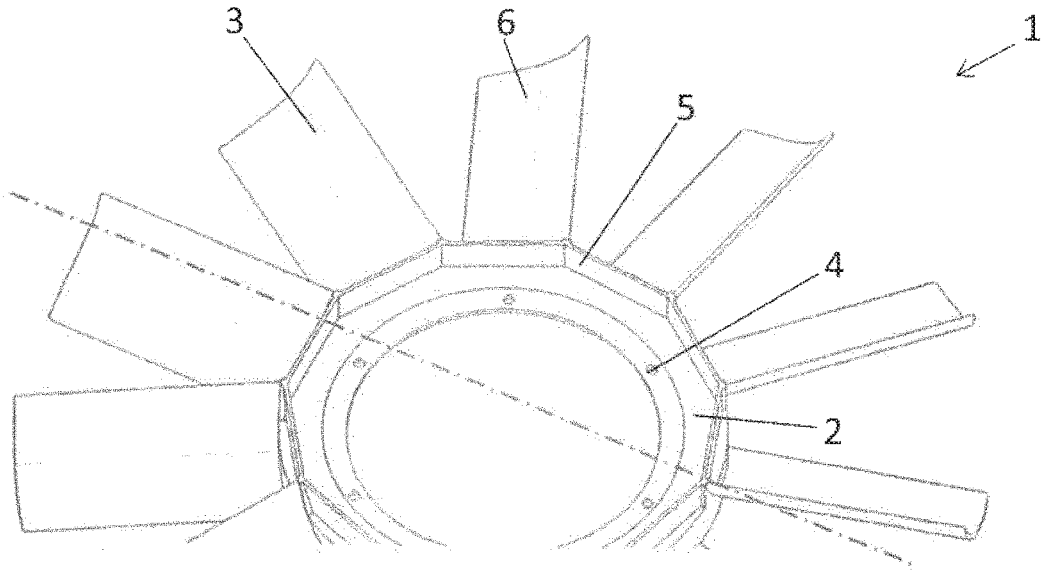
FIG. 1 shows an exemplary embodiment of the fan wheel of the invention.

An exemplary embodiment of fan wheel 1 of the invention, which has a flat, ring-shaped hub 2, on which the plurality of fan blades 3 is arranged, which extend outwardly approximately in a radial direction, is illustrated in FIG. 1. Attachment points 4 for a visco coupling, which is not illustrated further, is shown on the radially inner edge of hub 2; fan wheel 1 can be fastened to the points and fan wheel 1 can be connected via the points to a shaft of an internal combustion engine.

Different bars 5 are attached to the flat, ring-shaped hub 2; these are made flat and rectangular and lead from one fan blade 3 to the directly following fan blade 6. In this case, bars 5 are in contact at their respective ends in the circumferential direction of hub 2 and do not cross. In this case, a bar 5 begins approximately at the level of one of the edges of a fan blade 3 and ends approximately at the other edge of fan blade 3.

Figure 2:
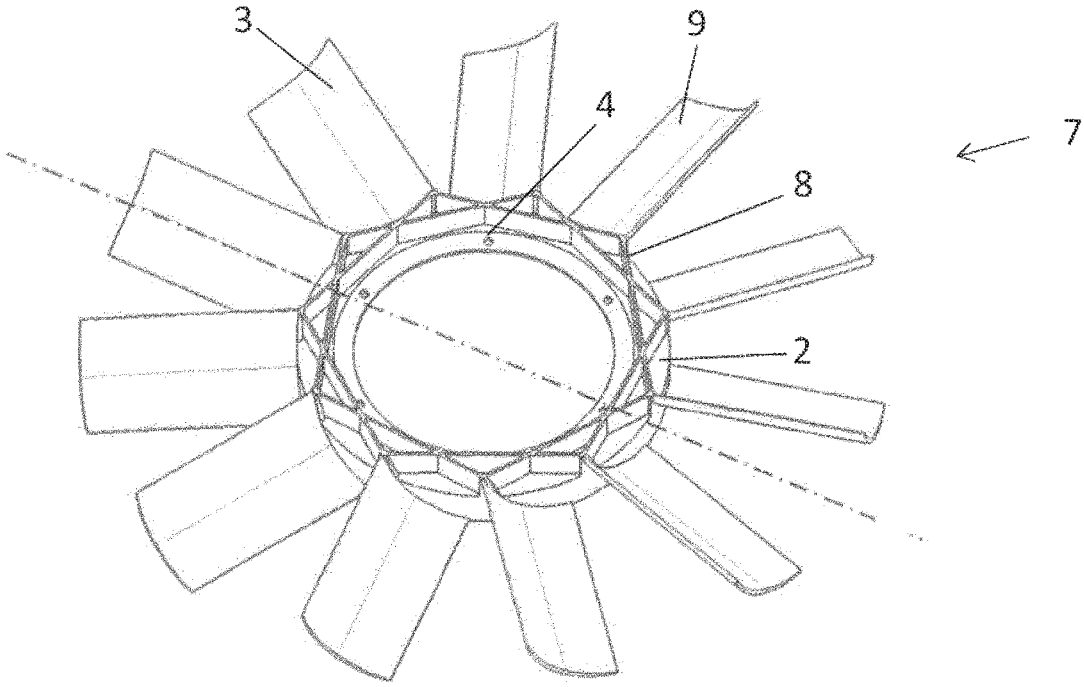
FIG. 2 shows an exemplary embodiment of the fan wheel of the invention.

FIG. 2 shows a fan wheel 7, in which likewise approximately rectangular and flat bars 8 are arranged at the flat, ring-shaped hub 2 between fan blades 3, 9. In this embodiment of FIG. 2, the individual bars 8 lead from one edge of a fan blade 3 to the corresponding edge of the next but one fan blade 9, whereby bars 8 cross one another twice. Thus, bar 8 that begins at the front edge of fan blade 3 leads in the rotation direction to the front edge of the next but one fan blade 9.

Bar 8 ending at one fan blade 3, 9 in this case connects to another bar 8, which originates from the same fan blade 3, 9, whereby an angle is enclosed between the two bars. This design in which a straight bar 8 leads from each fan blade 3 to the next but one fan blade 9 achieves an especially stable structure, which impedes the dynamic strength of fan wheel 6 relative to axial displacement and/or tipping. The stiffness of fan wheel 7 is thereby increased according to the invention.

Figure 3:
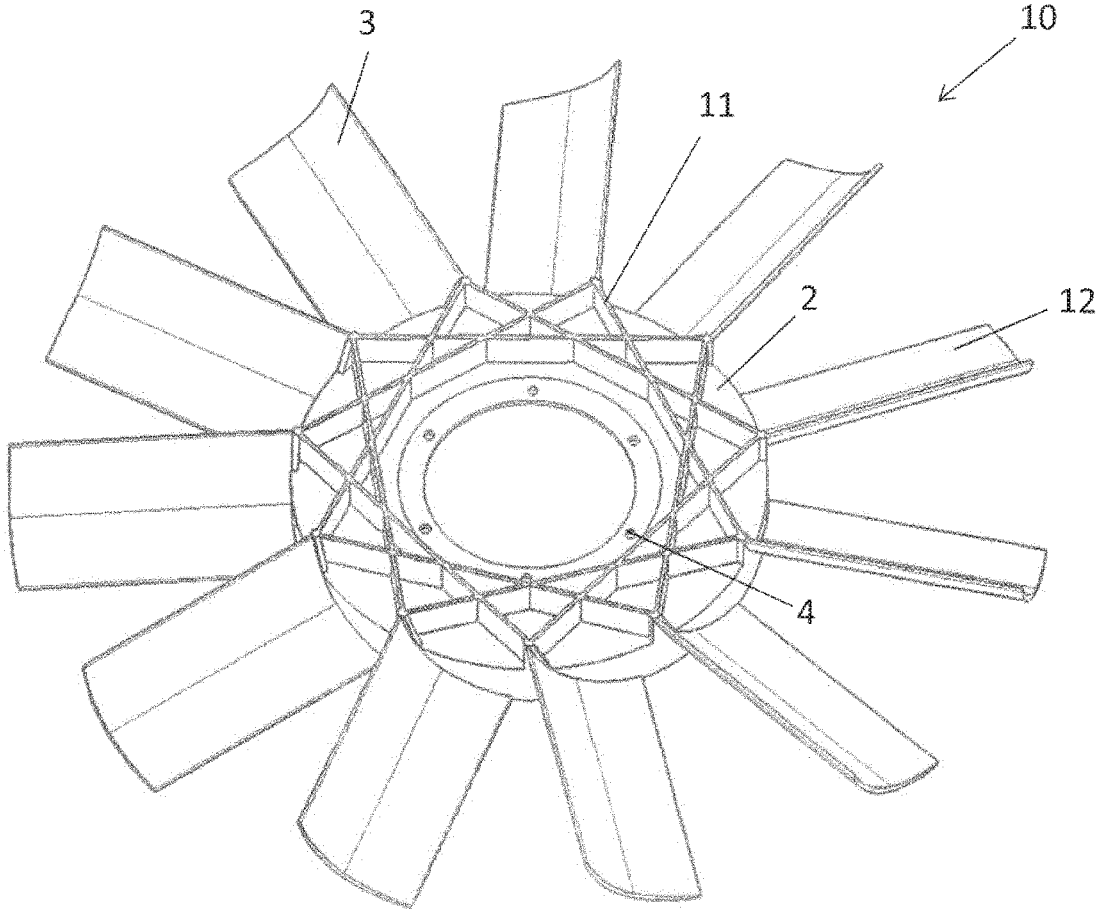
FIG. 3 shows an exemplary embodiment of the fan wheel of the invention.

In fan wheel 10 illustrated in FIG. 3, a highly interconnected structure of the flat and rectangular bars 11 can be seen on the flat, ring-shaped hub 2, whereby in each case a bar 11 extends from one fan blade 3 to the third next fan blade 12. In this case, a bar begins at a front edge of one fan blade 3 and ends at the front edge of the third next fan blade 11. In this regard, bars 11 cross 4 times along the extent of a bar 11, whereby in so doing the crossing bars 11 form a symmetric structure. Bars 11 are brought relatively close to the center, therefore to the axis of rotation, of fan wheel 10 by means of such an illustrated complex structure and assure that the fan wheel has a sufficient stiffness.

Figure 4:
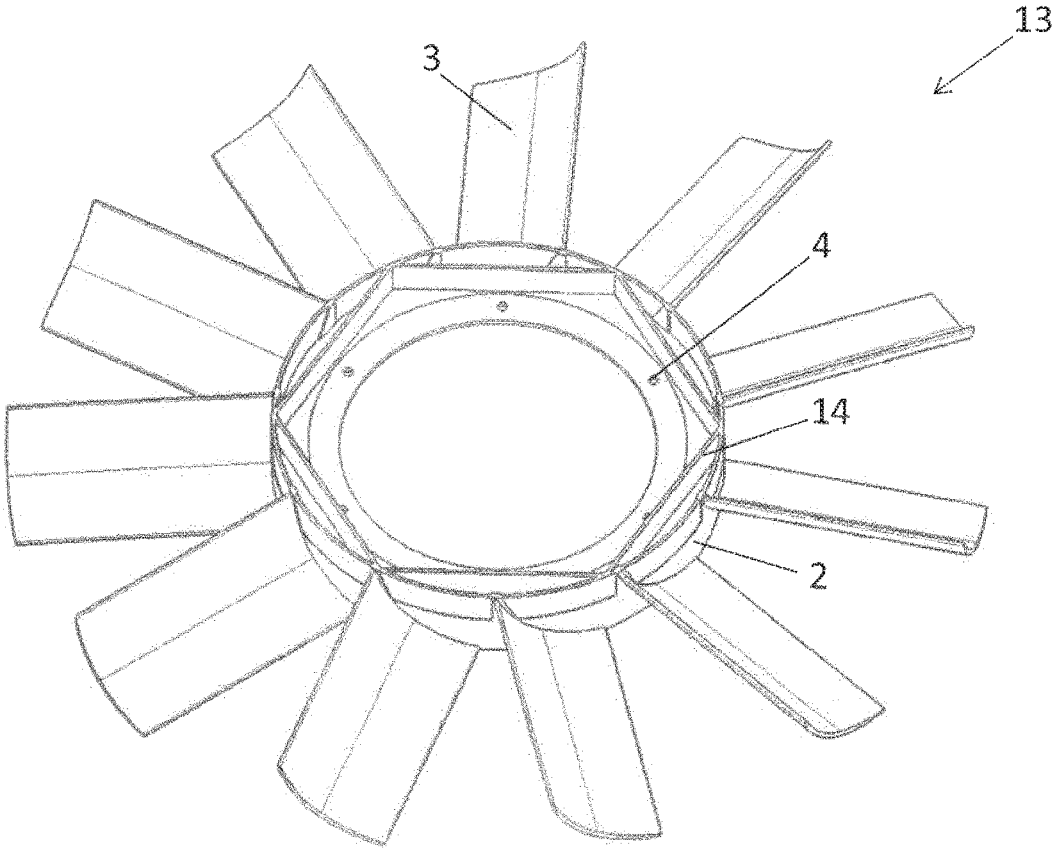
FIG. 4 shows an exemplary embodiment of the fan wheel of the invention.

FIG. 4 shows an exemplary embodiment of fan wheel 13, in which the flat and approximately rectangular bars 14 run particularly close to attachment points 4 of the visco coupling and which comprises eleven fan blades 3, which are stabilized by six, non-intersecting straight bars 14. In this case, three bars extend along half the circumference of hub 2. Such a design can be combined advantageously with a classic rib principle of hub 2.

Hub ramps can be provided or optionally, if desired, these can also be omitted in the described solutions.

The designs of the invention can be used in particular also in the designs according to DE 10 2010 042 325 A1, which corresponds to U.S. Pat. No. 9,447,791, which are incorporated herein by reference.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A fan wheel for propelling cooling air for an internal combustion engine, the fan wheel comprising:

a hub on which a plurality of fan blades are arranged; and a rib structure provided on the hub, the rib structure extending peripherally around a circumference of the hub and having substantially rectangular and flat ribs each having a lower edge region that is arranged on the hub, the flat ribs being in contact with one another, wherein the hub has a flat ring shape with a flat upper surface, and wherein the lower edge region of each flat rib is arranged on and is directly mounted to the flat upper surface of the hub, such that each flat rib extends perpendicularly from the flat upper surface of the hub.

2. The fan wheel according to claim 1, wherein each flat rib extends from one fan blade to another fan blade.

3. The fan wheel according to claim 2, wherein each flat rib extends from one fan blade to a directly adjacent fan blade.

4. The fan wheel according to claim 2, wherein each flat rib extends from one fan blade to the second next fan blade.

5. The fan wheel according to claim 2, wherein each flat rib extends from one fan blade to the third next fan blade.

6. The fan wheel according to claim 1, wherein the straight ribs run close to screw points of a coupling of the fan, without crossing one another.

7. A visco fan for propelling cooling air for an internal combustion engine, comprising a fan wheel according to claim 1, the fan wheel being connected to a shaft of the internal combustion engine via a visco coupling.

8. The fan wheel according to claim 2, wherein each flat rib has the lower edge region, an upper edge region and side edges, wherein a side edge of one of the flat ribs is directly connected to a side edge of a second one of the flat ribs.

9. The fan wheel according to claim 4, wherein adjacent flat ribs cross over each other.

10. The fan wheel according to claim 5, wherein adjacent flat ribs cross over each other.

11. The fan wheel according to claim 1, wherein each of the fan blades are directly mounted to the hub.

12. The fan wheel according to claim 1, wherein each flat rib is arranged entirely on the flat upper surface of the hub.

* * * * *